US008150241B2

(12) United States Patent
Kretkowski

(10) Patent No.: US 8,150,241 B2
(45) Date of Patent: Apr. 3, 2012

(54) BASEBOARD HEATER SECURITY DEVICE

(76) Inventor: Eugene Michael Kretkowski, Pequannock, NJ (US)

( * ) Notice: Subject to any disclaimer, the term of this patent is extended or adjusted under 35 U.S.C. 154(b) by 966 days.

(21) Appl. No.: 12/151,138

(22) Filed: May 2, 2008

(65) Prior Publication Data

US 2009/0123138 A1 May 14, 2009

Related U.S. Application Data

(60) Provisional application No. 60/986,551, filed on Nov. 8, 2007.

(51) Int. Cl.
*F24D 19/04* (2006.01)

(52) U.S. Cl. ..... 392/352; 237/79

(58) Field of Classification Search ..... 392/347–378; 126/210; 237/79; 454/287–288; 165/53–57
See application file for complete search history.

(56) References Cited

U.S. PATENT DOCUMENTS

| | | | | |
|---|---|---|---|---|
| 2,976,023 | A * | 3/1961 | Gillick et al. | 165/48.1 |
| 3,443,061 | A * | 5/1969 | Welch, Sr. | 392/354 |
| 4,258,654 | A * | 3/1981 | Ivankovich | 118/504 |
| 4,314,543 | A * | 2/1982 | Bullington et al. | 126/201 |
| 4,483,313 | A * | 11/1984 | Kojima et al. | 126/92 R |
| 4,541,408 | A * | 9/1985 | Ratelband | 126/524 |
| 6,085,985 | A * | 7/2000 | LaSelva | 237/79 |
| 2004/0261781 | A1* | 12/2004 | Sengoku | 126/201 |

FOREIGN PATENT DOCUMENTS

| | | |
|---|---|---|
| JP | 10-185214 | 7/1998 |
| JP | 3067648 | 4/2000 |

* cited by examiner

*Primary Examiner* — Daniel L Robinson
(74) *Attorney, Agent, or Firm* — Klauber & Jackson LLC

(57) ABSTRACT

The present invention relates to a baseboard heater guard or security device designed to shield the upper and front surfaces of a baseboard heater. The guard or security device comprises two or more vertical members that substantially follow the contour of the outside surface of the baseboard heater forming a frame around the heater. The vertical members comprise or are attached to a fixing member designed for attachment on the wall above the baseboard heater and a second fixing member designed for attachment at a second point on the floor. One or more first horizontal members are attached to the two or more vertical members near the top surface of the baseboard heater. One or more second horizontal members are attached to the two or more vertical members near the front surface of the baseboard heater. Optionally, one or more third horizontal members are attached to at least one first horizontal member or to at least one vertical member, and optionally, one or more fourth horizontal members are attached to at least one second horizontal member or to at least one vertical member substantially creating a barrier on top of the top surface and in front of the front surface of the baseboard heater.

8 Claims, 1 Drawing Sheet

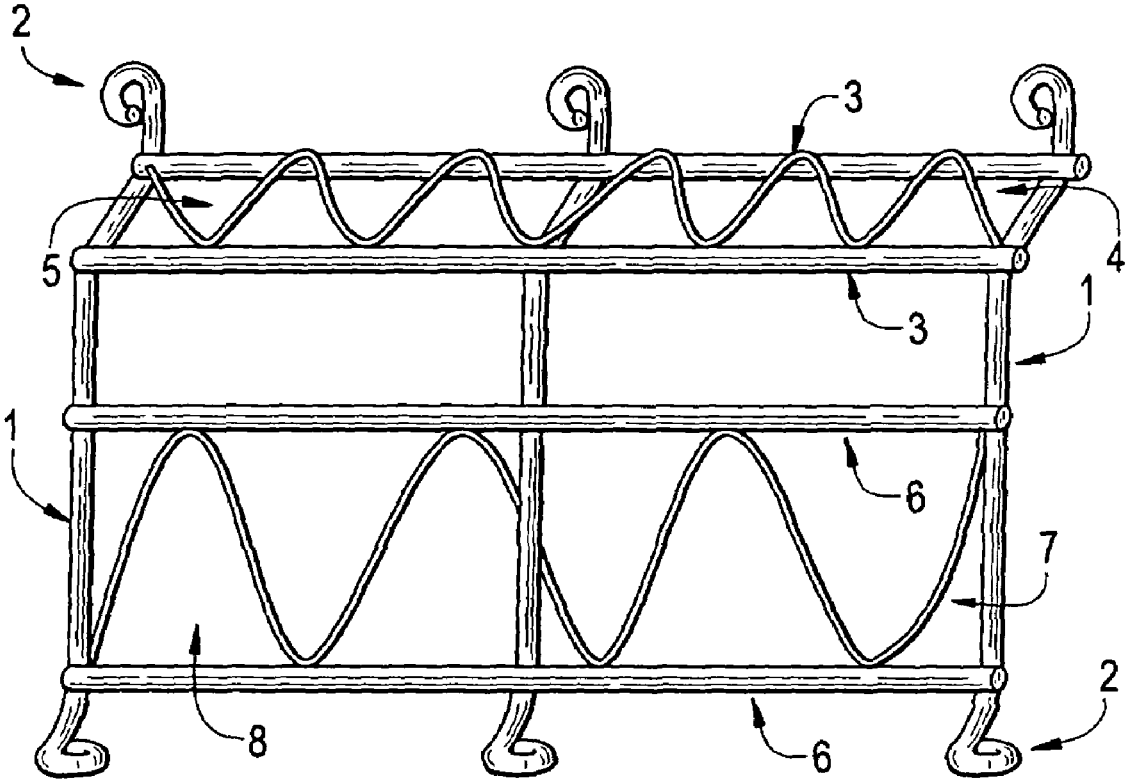
2
3
5
4
3
1
1
6
7
8
6
2

BASEBOARD HEATER SECURITY DEVICE

The present application claims priority to U.S. Provisional Application No. 60/986,551, filed Nov. 8, 2007, the disclosure of which is herein incorporated by reference.

BACKGROUND OF THE INVENTION

The present invention relates to a baseboard heater guard. More particularly, it relates to a baseboard heater guard designed to substantially prevent contact with the baseboard heater thereby functioning as both a safety device and a device to reduce damage to the baseboard heater itself. The device is designed for use with an indoor baseboard heater such as a gas, steam or electric heater.

Heater guards as safety measures for use with oil heaters or electric heaters are well known in the art, for example in Japanese Patent Publication No. 10-185214 entitled "Guard for Heaters," Japanese Utility Model Registration No. 3,067,648 entitled "Heater Guard," and U.S. Patent Publication No. 20040261781 entitled "Circular Heater Guard." These heater guards are designed for use with rectangular heaters or circular heaters.

Baseboard heaters are commonly provided in temperate or moderate climates as a way to evenly heat living spaces. They are commonly operated by electricity and are arranged along one or more walls of a room substantially near the floor. They are commonly from about 4 to about 15 inches, high, often about 8 or 9 inches high in relation to the floor surface. Also, they commonly are from about 2 to about 6 inches wide, often about 3 or 4 inches wide in relation to the wall surface. They are commonly from about 1 to about 6 feet long in sections, often about 3 feet long, and the sections may be joined to provide a total length that is additive of the individual sections.

Baseboard heaters commonly have a temperature limiting device that may be accessible from the outside of the heater, and they often feature a levered apparatus that may be opened or closed to regulate the release of heat. The present invention relates to a baseboard heater guard or security device having protective functions for the top surface and the front surface of the baseboard heater, and it is an object thereof to prevent people from coming too close thereto thereby preventing any potential injury to people and protecting the heater itself from damage caused by contact.

SUMMARY OF THE INVENTION

The baseboard heater guard or security device of the present invention is designed to substantially shield the upper and front surfaces of a baseboard heater after it is installed on a wall. The baseboard heater guard or security device is comprised of two or more vertical members that substantially follow the contour of the outside surface of the baseboard heater once installed thereby forming a frame around the baseboard heater. The vertical members comprise or are attached to a fixing member designed to permit attachment at one point on the wall above the top surface of the baseboard heater and a second fixing member designed to permit attachment at a second point on the floor either in front of or near to the front surface of the baseboard heater, one or more first horizontal members attached to the two or more vertical members near the top surface of the baseboard heater thereby providing a scaffold or guard above the top surface of the baseboard heater, one or more second horizontal members attached to the two or more vertical members near the front surface of the baseboard heater thereby providing a scaffold or guard in front of the front surface of the baseboard heater, optionally, one or more third horizontal members attached to at least one first horizontal member or to at least one vertical member substantially creating a barrier over the top surface of the baseboard heater, and optionally, one or more fourth horizontal members attached to at least one second horizontal member or to at least one vertical member substantially creating a barrier in front of the front surface of the baseboard heater.

According to the present invention, the vertical members and the horizontal members may be formed of wire, plastic, rubber or any suitable metal. The wire, plastic, rubber or metal may be hollow or solid, and it may be of any suitable density or thickness. In preferred embodiments, the wire, plastic, rubber or metal is relatively rigid to avoid any substantial alteration in shape such as bending even with substantial pressure or weight. In preferred embodiments, there are three, four or five vertical members and two first horizontal members and two second horizontal members. In some embodiments, there is a single third horizontal member and a single fourth horizontal member each formed in a curved shape, for instance as a parabolic curve having alternating angles, engaging each of the first and second horizontal members as well as each of the vertical members.

The vertical members may either substantially follow the contour of the baseboard heater once it is mounted to the wall or they may form a substantially square or rectangular space around the baseboard heater. For instance, each vertical member may in one portion be substantially horizontal to the wall, may form an angle of, for example about 75° to about 150°, especially about 90° to about 125°, may extend in another portion substantially parallel to the top surface of the baseboard heater, may form a second angle of, for example about 90° to about 150°, especially about 90° to about 125°, may extend in yet another portion substantially parallel to the front surface of the baseboard heater, and may optionally form yet a third angle of for instance about 10° to about 60° to extend in still another portion to a fixing device. In some embodiments, there may be an additional angle between the first second angles of, for example, about 90° to about 150° thereby allowing the vertical member to substantially follow the contour of the baseboard heater when the baseboard heater doesn't form a perfectly rectangular shape. Both ends of the vertical members form a fixing device or are attached to a fixing device. The fixing device may form a substantial arc or circle having a void therein so as to allow a screw or nail to engage the vertical member to the floor or the wall. The fixing device may also form a substantially flat surface allowing for attachment to the wall and floor by glue, cement or other suitable substance or device for forming an engaging connection.

The horizontal members may substantially follow the contour of the baseboard heater once it is mounted to the wall or they may follow substantially horizontal to the surface of the wall or to the surface of the floor. In some embodiments, one first horizontal member is nearer the surface of the floor than the other first horizontal member to that in total, the top of the baseboard heater guard or security device is not perfectly parallel to the surface of the floor. The horizontal members provide an effective barrier to prevent contact with the surface of the baseboard heater. The third and fourth horizontal members may form a decorative pattern by forming angles of bent wire, plastic, rubber or metal, or the third and fourth horizontal members may be substantially solid panels of wire, plastic, rubber or metal that are adapted to engage with the first and second horizontal members and thereby provide a decorative function. The engagement may be permanent or may be designed to be temporary via a second fixing member that may be engaged or disengaged.

The members of the baseboard heater guard or security device function together to provide an effective shield preventing human contact to the top and front surfaces of the baseboard heater in undesired locations. The baseboard heater guard or security device is designed to provide a void space of about ½", 1", 2", 3", or even 6" between it and the top and front surfaces of the baseboard heater. The baseboard heater guard or security device is further designed to provide an opening allowing access to a portion of the top surface or a portion of the front surface of the baseboard heater, or both. The opening thereby allows some contact with the baseboard heater to regulate any adapters, switches or levered devices that may be adjusted.

BRIEF DESCRIPTION OF THE DRAWINGS

FIG. 1 is a schematic front view illustrating the members of the baseboard heater guard or security device forming the whole.

DETAILED DESCRIPTION OF THE INVENTION

One embodiment of the present invention is now explained with reference to the accompanying drawings in order to describe the present invention in further detail.

With reference to FIG. 1, a baseboard heater guard or security device of the present invention is comprised of two or more, preferably three, vertical members 1 that follow the contour of the outside surface of the baseboard heater once installed thereby forming a frame around the baseboard heater. The vertical members 1 comprise or are attached to a fixing member 2 designed to permit attachment at one point on the wall above the top surface of the baseboard heater and a second fixing member 2 designed to permit attachment at a second point on the floor either in front of or near to the front surface of the baseboard heater. The fixing members 2 may be attached to the wall and the floor, respectively, by any suitable device such as, for instance, a nail, screw, bolt, bolt rod, fly nut, etc., having a space for engagement of such a suitable device therethrough. The vertical members 1 substantially follow the contour of the outer surface of the baseboard heater while being suitably spaced apart therefrom.

One or more, preferably two, first horizontal members 3 are attached to or engaged with the two or more vertical members 1 near the top surface of the baseboard heater thereby providing a scaffold or guard above the top surface of the baseboard heater. One or more third horizontal members 4 are attached to or engaged with the first horizontal members 3 substantially creating a barrier over the top surface of the baseboard heater. The third horizontal member 4 forms a substantial parabolic curve or sinusoid curve shape and engages or attaches to the first horizontal members 3 at multiple points. Together, the first and third horizontal members 3, 4, attached to the vertical members 1 provide a guard 5 over the top surface of the baseboard heater while being suitably spaced apart therefrom.

One or more second horizontal members 6 are attached to or engaged with the two or more vertical members 1 near the front surface of the baseboard heater thereby providing a scaffold or guard above the front surface of the baseboard heater. One or more fourth horizontal members 7 are attached to or engaged with the second horizontal members 6 substantially creating a barrier over the front surface of the baseboard heater. The fourth horizontal member 7 forms a substantial parabolic curve or sinusoid curve shape and engages or attaches to the second horizontal members 6 at multiple points. Together, the second and fourth horizontal members 6, 7, attached to the vertical members 1 provide a guard 8 over part of the front surface of the baseboard heater while being suitably spaced apart therefrom.

Between the first and second horizontal members 3, 6 is formed a space of sufficient size as to allow human fingers to contact the baseboard heater and effect adjustment of any levered members or switches or knobs that may be adjusted.

The vertical members, the horizontal members, and the fixing devices 2 may be formed of wire that is approximately ⅛" to ½" inch in diameter.

The present invention provides a protective guard that effectively prevents damage to and extends the life of baseboard heaters.

The invention claimed is:

1. A baseboard heater guard or security device comprising at least two vertical members substantially following the contour of an outside surface of the baseboard heater adapted for attaching at one point above a top surface of the baseboard heater and adapted for attaching at a second point to a floor, at least one first horizontal member attached to the two or more vertical members near the top surface of the baseboard heater, at least one second horizontal member attached to the two or more vertical members near the front surface of the baseboard heater, and at least one third horizontal member attached to the at least one first horizontal member or to at least one vertical member substantially creating a barrier over the top surface of the baseboard heater.

2. A baseboard heater guard or security device according to claim 1 further comprising at least one fourth horizontal members attached to at least one second horizontal member or to at least one vertical member substantially creating a barrier in front of the front surface of the baseboard heater.

3. A baseboard heater guard or security device according to claim 1 wherein the vertical members and the horizontal members are formed of wire, plastic or rubber.

4. A baseboard heater guard or security device according to claim 1 further comprising at least three vertical members and two first horizontal members and two second horizontal members.

5. A baseboard heater guard or security device according to claim 1 wherein the third horizontal member is formed in a curved shape.

6. A baseboard heater guard or security device according to claim 1 wherein one first horizontal member is nearer the surface of the floor than a second first horizontal member.

7. A baseboard heater guard or security device according to claim 1 that provides a void space of at least ½".

8. A baseboard heater guard or security device according to claim 1 that provides an opening allowing access to a portion of the top surface or a portion of the front surface of the baseboard heater, or both.

* * * * *